US005672091A

United States Patent [19]

Takahashi et al.

[11] Patent Number: 5,672,091

[45] Date of Patent: Sep. 30, 1997

[54] POLISHING APPARATUS HAVING ENDPOINT DETECTION DEVICE

[75] Inventors: Tsutomu Takahashi, Yokohama; Keiichi Tohyama, Kawasaki; Tamami Takahashi, Yamato, all of Japan

[73] Assignee: Ebara Corporation, Tokyo, Japan

[21] Appl. No.: 577,536

[22] Filed: Dec. 22, 1995

[30] Foreign Application Priority Data

Dec. 22, 1994 [JP] Japan ..... 6-336422

[51] Int. Cl.[6] ..... B24B 49/00; B24B 51/00

[52] U.S. Cl. ..... 451/6; 451/288; 451/287; 451/42

[58] Field of Search ..... 451/42, 288, 28, 451/287, 277, 6, 8, 5, 342, 67, 256, 41, 10, 11, 159, 285, 259

[56] References Cited

U.S. PATENT DOCUMENTS

| | | | |
|---|---|---|---|
| 4,956,944 | 9/1990 | Ando et al. | 451/5 |
| 5,081,796 | 1/1992 | Schultz . | |
| 5,196,353 | 3/1993 | Sandhu et al. | 451/288 |
| 5,222,329 | 6/1993 | Yu | 451/11 |
| 5,245,794 | 9/1993 | Salugsugan | 451/8 |
| 5,308,438 | 5/1994 | Cote et al. | 156/636 |
| 5,433,651 | 7/1995 | Lustig et al. | 451/6 |
| 5,492,594 | 2/1996 | Burke et al. | 451/286 |

FOREIGN PATENT DOCUMENTS 6-21774 3/1994 Japan .

*Primary Examiner*—James G. Smith
*Assistant Examiner*—Derris H. Banks
*Attorney, Agent, or Firm*—Wenderoth, Lind & Ponack

[57] ABSTRACT

A polishing apparatus has an automated endpoint detection device to determine if an endpoint of polishing has been reached without removing the wafer from a top ring of the polishing apparatus. When a pre-determined inspection time is reached in a process of polishing, the wafer is moved laterally along the turntable and the current surface condition of the wafer is determined by comparing the current surface condition with an initial surface condition, having an oxide film for example, determined from surface reflection measurement data carried out opto-electronically on the wafer before polishing. The endpoint detection device can be used to remove the surface oxide film so that the apex of the underlying device elements are just exposed. By eliminating the need for removing the wafer from the top ring for inspection, the cost of handling the wafer for polishing is reduced significantly, and enables reduction in the cost of manufactured devices. The endpoint determination device is applicable to any type of flat objects, such as LCD panels, requiring a high degree of polishing precision.

12 Claims, 7 Drawing Sheets

POLISHING APPARATUS HAVING ENDPOINT DETECTION DEVICE

BACKGROUND OF THE INVENTION

1. Field of the Invention

The present invention relates in general to a polishing apparatus, and relates in particular to a polishing apparatus which enables the detection of the endpoint of polishing without removing a wafer from a top ring of a polishing apparatus for inspection.

2. Description of the Related Art

High density integrated semiconductor devices of recent years require increasingly finer microcircuits, and there also has been a steady trend to decrease the interline spacing. For optical lithography operations based on less than 0.5 micrometer interline spacing, the depth of focus is shallow and high precision of flatness is required on the surface of the polished object which has to be coincident with the focusing plane of the stepper. This requirement means that the wafer surface must be made extremely flat, and one of the methods to achieve such precision in flatness is to polish the surface with a polishing apparatus by supplying a chemical solution.

Conventional polishing apparatuses are provided with a revolving turntable and an opposing revolving top ring with independent control of revolution speed of each, and polishing is carried out to produce a flat and mirror polished surface by placing a semiconductor wafer to be polished between the top ring and the turntable while the top ring presses the wafer down at a given pressure against the turntable.

One of the operational problems in carrying out polishing using such conventional polishing apparatuses is to determine when polishing should be ended, i.e. an endpoint of polishing, based on such parameters as the degree of flatness or the thickness of the wafer. For example, after forming a vapor deposit on a wafer and fabricating various kinds of integrated circuit (IC) devices on the deposit, it is often required that a surface oxide film be removed to a certain depth. To perform such a removal or planarizing step, it is desirable that the oxide layer be removed to expose the apex of the IC devices without removing any part of the active elements of the IC devices. This technique requires a delicate control of final thickness of the wafer.

In the conventional wafer processing methodology, the planarization step has been carried out by controlling polishing parameters such as the rotational speed of the turntable and the top ring, the pressure exerted by the top ring and the duration of material removal by chemical etching and/or mechanical polishing. The endpoint of polishing is determined by removing the wafer from the top ring, and measuring the size and the flatness of the wafer by some known physical methods to check if the thickness or flatness is within a required range.

If it is determined that the wafer does not meet requirements, the wafer is re-mounted on the top ring to perform another planarization step. In other words, the conventional methodology is based on repeating the cycle of polishing and inspection until it is determined than the desired endpoint has been reached. It is clear that the conventional method is labor-intensive and contributes to inefficiency and high cost of polishing operations.

SUMMARY OF THE INVENTION

It is an object of the present invention to provide a polishing apparatus provided with a detection device to enable detection of whether or not an endpoint of polishing has been reached, without removing a wafer from the polishing apparatus.

This object is achieved by provision of a polishing apparatus, for polishing an object being held on an independently controlled top ring pressing the object down onto an independently controlled turntable, having an endpoint detection means for detecting an endpoint for stopping polishing of a surface on the object. The endpoint detection means includes beam emitting means for projecting light beams onto an exposed portion of the surface of the object being held on the top ring. Beam receiving means receive reflected beams reflected from the exposed portion of the surface. Judging means determines a current surface condition of the surface from analysis of the reflected beams.

An aspect of the polishing apparatus having the endpoint detection device is that the judging means determines an endpoint on a basis of changes in intensities of reflected beams reflecting from a current surface condition of the surface.

Another aspect of the polishing apparatus having the endpoint detection device is that the endpoint judging means comprises an electrical amplifier for amplifying electrical analogue signals received by the beam receiving device. An analogue signal filtering device filters noise from the amplified analogue electrical signals. An analogue-to-digital conversion device converts the amplified analogue electrical signals to digital signals. A computing device computes an absolute value of a difference between an initial surface data of the surface in an initial unpolished state and the digitalized current surface data, and compares the absolute value with a pre-determined threshold value. A controlling device controls the polishing operation based on such comparison data.

Still another aspect of the polishing apparatus having the endpoint detection device is that the beam emitter device of the endpoint detection device is provided with a plurality of emitter elements disposed at a common distance from the surface, and the beam receiving device of the endpoint detection device is provided with a plurality of corresponding receiver elements disposed at a common distance from the surface. The computing device is provided with a comparing device for computing an absolute value of a difference between an added value or an averaged value of the initial surface data and an added value or an averaged value of current surface data, and comparing the difference with the pre-determined threshold value.

Another aspect of the endpoint detection device is that each of the emitter elements is arranged so as to produce a linear line of incident points on the surface, and each of the receiver elements is arranged linearly so as to correspond with the each of the emitter elements and at an equal distance from the surface of the object being polished.

According to the endpoint detection device presented above, an endpoint inspection process can be carried out without removing the wafer from the top ring. The inspection process is carried out automatically when appropriate by sliding the top ring laterally, and projecting light beams onto an exposed portion of the surface and determining the difference between the current surface data and the initial surface data pre-determined on the wafer before the polishing process is started. If the inspection process determines that the wafer needs further polishing, the wafer is automatically returned to the turntable for further polishing, while if it is not ready to be demounted, then the polishing apparatus is stopped to remove the wafer from the top ring.

It is clear that, once the wafer is mounted on a top ring, the wafer need not be demounted until it is ready for a next step of device processing, thus greatly reducing the need for handling and increasing the operational efficiency of polishing operation significantly.

DESCRIPTION OF THE PREFERRED EMBODIMENTS

An embodiment of a polishing apparatus having an endpoint detection device (shortened to detection device hereinbelow) will be explained with reference to drawings.

Figure 1:
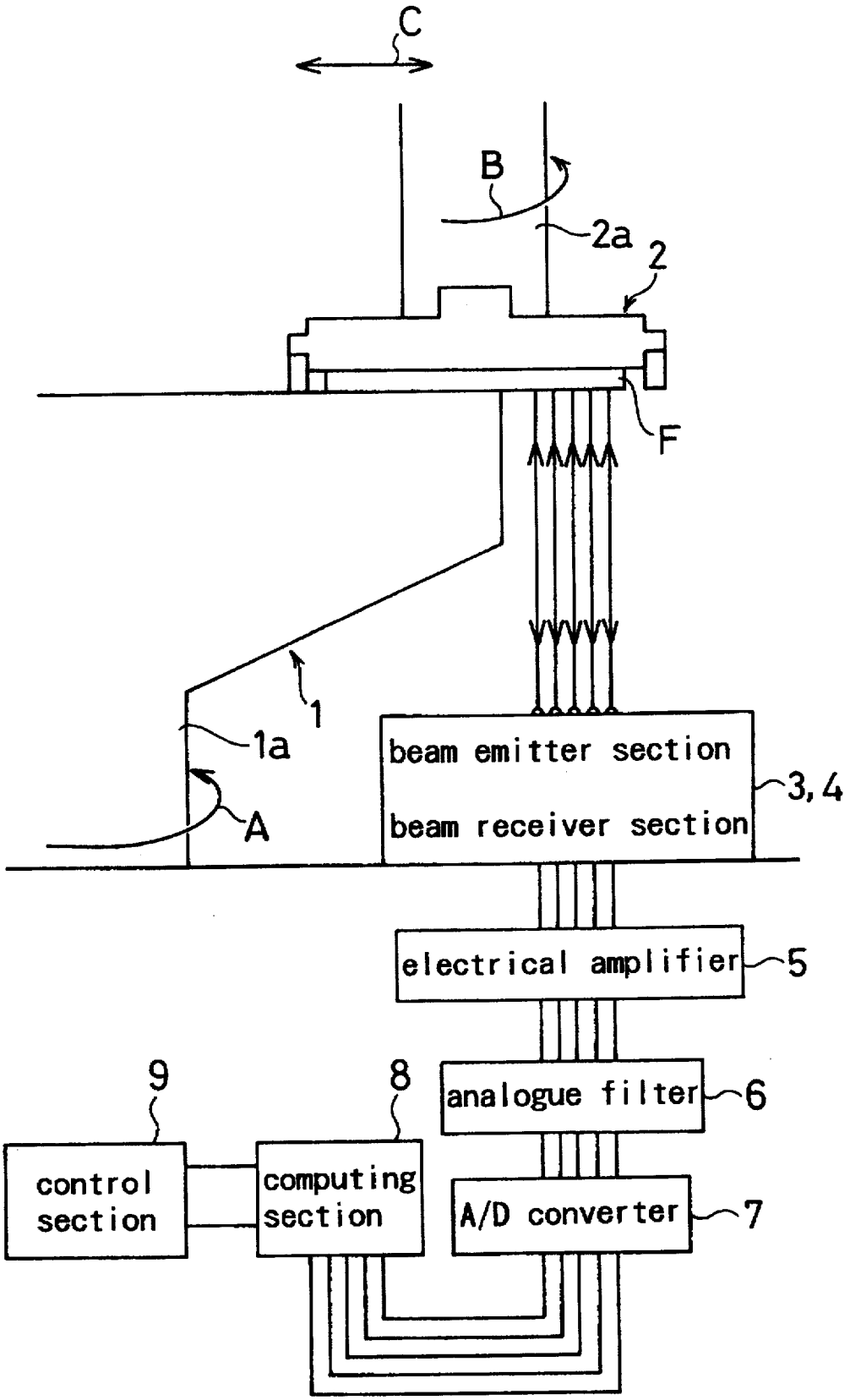
FIG. 1 is a schematic overall layout of a polishing apparatus having an endpoint detection device of the present invention.

FIG. 1 shows a cross sectional view of a top ring 2 and a turntable 1, together with an overall layout of the detection device. A shaft 1*a* of the turntable 1 revolves in the direction of an arrow A, and a ring shaft 2*a* of the top ring 2 revolves in the same direction indicated by an arrow B. A wafer F is placed between the turntable 1 and the top ring 2 which presses down the wafer F with a certain force onto the turntable 1 to polish a surface to be polished of the wafer in contact with the turntable 1.

Top ring 2 is movable laterally in the radial direction as indicated by an arrow C. During normal polishing, the entire surface being polished of the wafer F is in contact with the turntable 1. During an inspection period to check an endpoint, the wafer F is moved laterally so that an edge portion of the polished surface overhangs the turntable 1 as illustrated in FIG. 1. The wafer may be held in the top ring 2 by vacuum suction during an inspection period so as to be held at a correct position, if it is deemed to be necessary. In some applications, it may be desirable to lift the wafer F off the turntable 1 and move the wafer F laterally to expose more area of the polished surface for endpoint determination.

As shown in FIG. 1, the detection device comprises a beam emitter section 3, beam receiver section 4, an electrical amplifier 5, an analogue filter 6, an A/D converter 7, a computing section 8, and a control section 9. The beam emitter section 3 and the beam receiver section 4 are provided with a plurality of respective emitter elements and receiver elements which will be described in more detail below. Each of the light emitter elements projects a beam onto the surface being polished of the wafer F, and each of the beam receiver elements receives a reflected beam. The nature of the light beam should be such as to provide a targeting accuracy to precisely hit a narrow defined area, for example, a laser beam.

A reflected beam received in the beam receiver section 4 is converted to an electrical signal of a magnitude which is proportional to the intensity of the beam, and is amplified in the amplifier 5, and the output analogue signal is filtered through an analogue filter 6 to remove noise. Such analogue signal is converted to a digital signal in the A/D converter which is sampled at a certain sampling frequency.

The digital signals thus sampled are entered into the computing section 8 to determine the intensity of the individual reflected beam and to generate an added value. The added value is compared with initial surface data stored in the computing section 8 (which is the sum of the intensity of a reflected beam from the surface before any polishing is started). When the result of the comparison step indicates than a specified threshold value has been exceeded by an absolute value of the difference between the initial surface data and the added value, the computing section 8 sends a stop signal to the control section 9 to stop the polishing operation. If the threshold value has not yet been reached, the stop signal is not generated, and the control section 9 returns the top ring 2 holding the wafer F back onto the turntable 1 to continue the polishing operation.

Figure 2A:
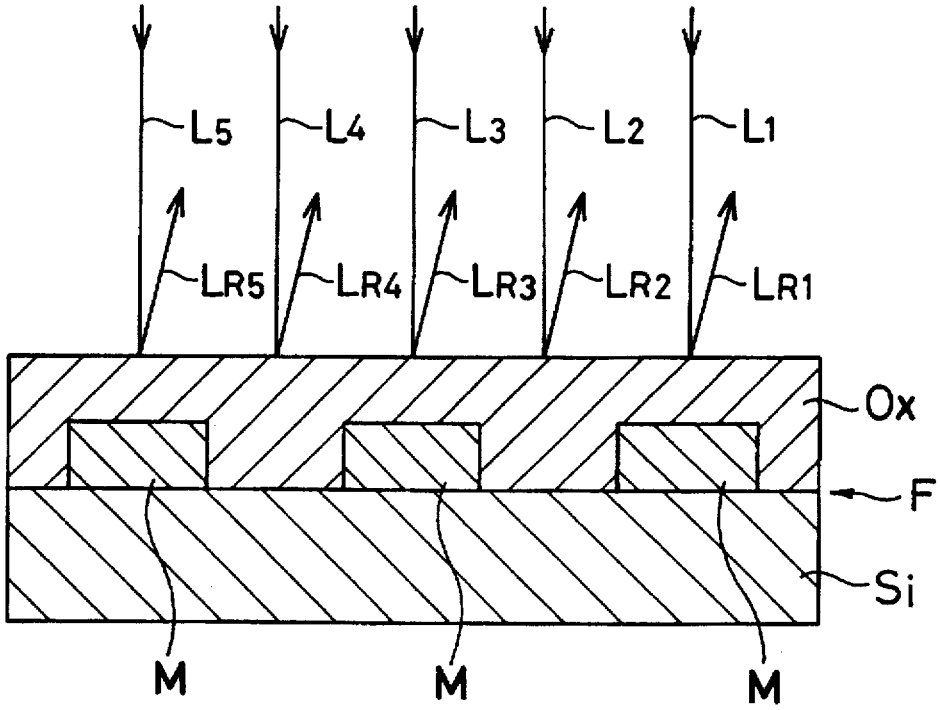
FIG. 2A is a schematic illustration of incident beams radiated on a wafer and reflected beams reflected from an oxide film of the wafer.
Figure 2B:
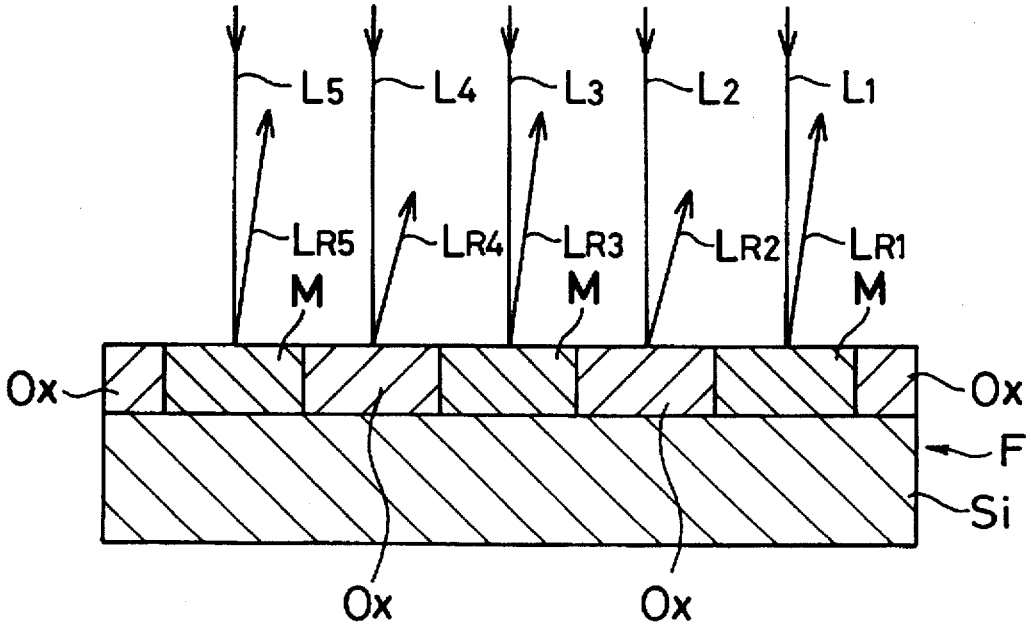
FIG. 2B is a schematic illustration of the incident beams radiated on a wafer and reflected beams reflected from a metal portion of the wafer.

FIG. 2A illustrates a case of incident beams L1–L5 projected onto a wafer F comprising an oxide film Ox formed on top of a silicon substrate and generating reflected beams LR1–LR5. FIG. 2B illustrates a case of the incident beams L1–L5 projected onto a polished surface of the wafer F having exposed metal portions M and generating the reflected beams LR1–LR5.

When the surface is covered with a uniform material, such as the oxide film Ox as illustrated in FIG. 2A, the intensities of the reflected beams LR1–LR5 from any portion of the polishing surface are the same. However, when polishing progresses to expose a foreign material, such as a metal portion M as illustrated in FIG. 2B, the behavior of the reflected beams, LR1, LR3, LR5, from the metal portion M is different than the reflected beams LR2, LR4, from the oxide film Ox, and their intensities become higher. It follows, therefore, that by projecting many beams onto the surface of a wafer F over a wide surface area and detecting the variation in the intensities of the reflected beams from such area, it becomes possible to detect non-uniformity of the surface, thereby making it possible to detect the endpoint of polishing. The endpoint detection device of the present invention is thus based on this methodology of detecting a non-uniformity revealed by removing the surface material from a surface being polished of a wafer.

Figure 3A:
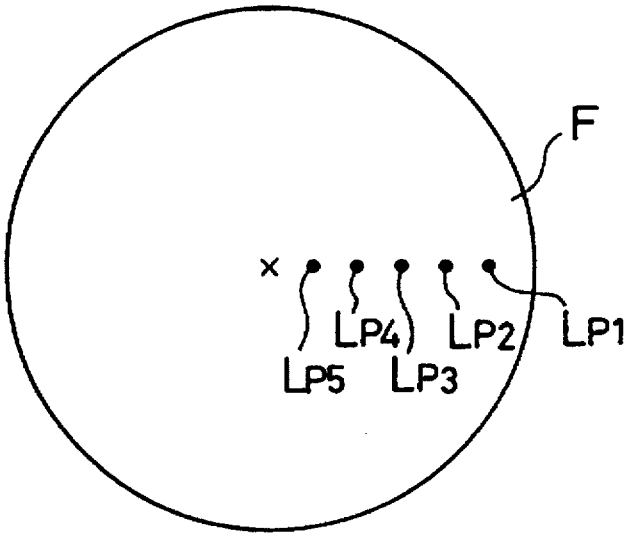
FIG. 3A is a plan view of incident points LP1–LP5 on a polished surface generated by incident beams L1–L5.
Figure 3B:
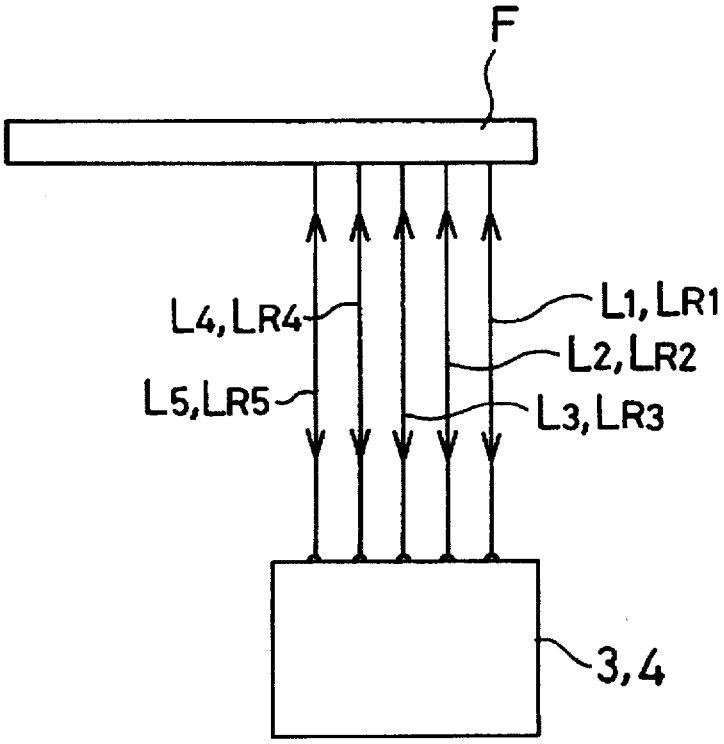
FIG. 3B is a front view of a beam emitter section and a beam receiver section.
Figure 3C:
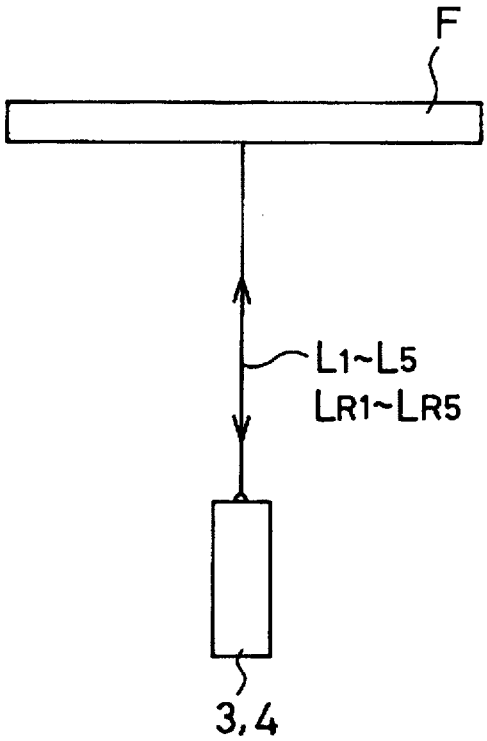
FIG. 3C is a side view of the beam emitter section and the beam receiver section.
Figure 3D:
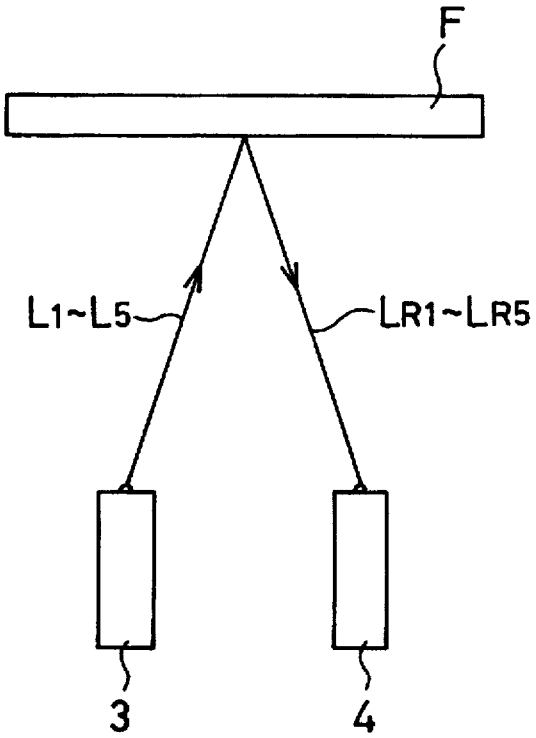
FIG. 3D is a side view of the beam emitter section and the beam receiver section of another embodiment.

FIG. 3A–3C show a case of a linear arrangement of the incident and reflected beams along a radial direction. FIG. 3A is a plan view of the surface radiated with the incident beams L1–L5 generating incident points LP1–LP5 thereon. FIG. 3B is a front view of an arrangement of the beam emitter section 3 and the beam receiver section 4. FIG. 3C is a side view of the beam emitter section 3 and the beam receiver section 4. FIG. 3D is a side view of another arrangement of the beam emitter section 3 and the beam receiver section 4. When the incident beams L1–L5 from the beam emitter section shown in FIG. 3B are radiated onto the wafer, the incident beams generate incident points LP1–LP5 aligned in a straight line along a radial direction as shown in FIG. 3A.

The angle of an incident beam projected onto the surface being polished may be varied as illustrated by two examples shown in FIGS. 3C and 3D. In one case, the incident beams L1–L5 and the reflected beams LR1–LR5 are at right angles to the surface as shown by FIG. 3C. The beam emitter section 3 may also radiate the incident beams L1–L5 at an angle to the surface and the beam receiver section 4 may be placed at the same angle to receive the reflected beams LR1–LR5, as shown in FIG. 3D.

Location of the beam emitter sections 3 and the beam receiver section 4 can be chosen from the two types described above so that the angle of incidence is either 90 degrees or some other angle. It is critical, however, that the emitter-to-receiver alignment be carried out at the highest precision achievable. In other words, an incident beam L1 emitted from a beam emitter element must be received by a particular beam receiver element as a reflected beam LR1.

Figure 4A:
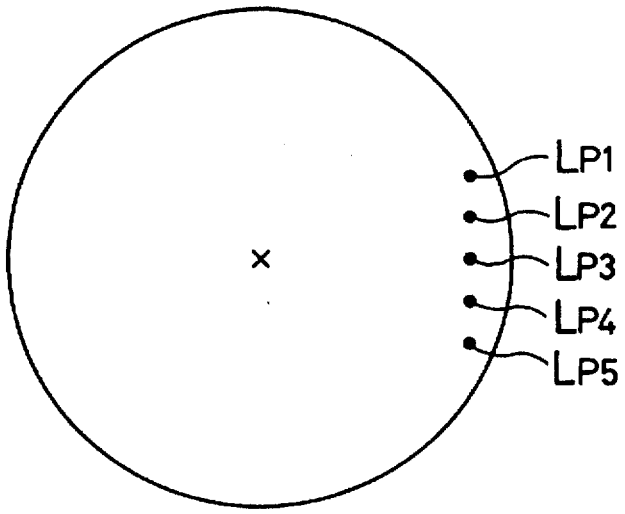
FIG. 4A is a plan view of the incident points LP1–LP5 on the polished surface generated by incident beams L1–L5.
Figure 4B:
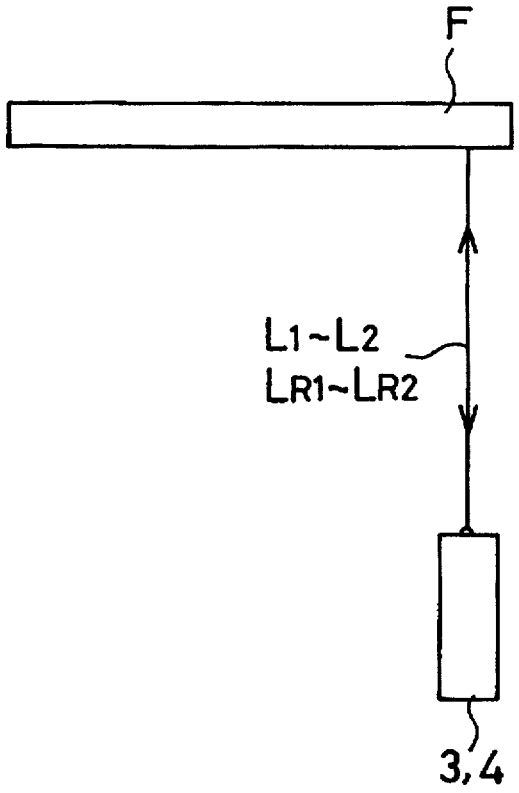
FIG. 4B is a front view of the beam emitter section and the beam receiver section.
Figure 4C:
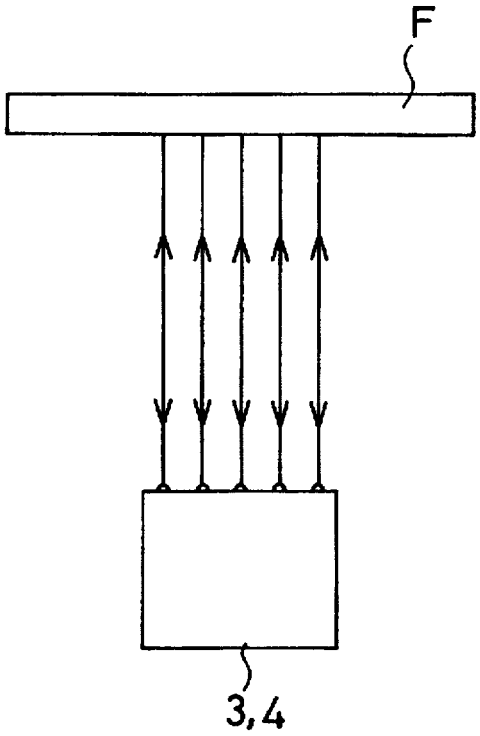
FIG. 4C is a side view of the beam emitter section and the beam receiver section.
Figure 4D:
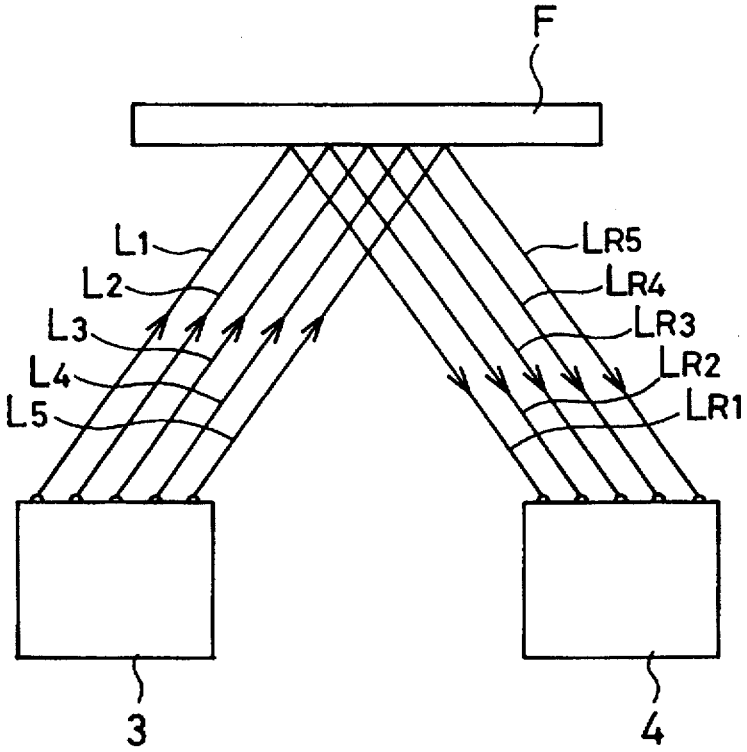
FIG. 4D is a side view of the beam emitter section and the beam receiver section of another embodiment.

FIGS. 4A–4C illustrate other examples of the alignment of the incident and reflected beams. In FIG. 4A, a plan view of the wafer F, the incident points LP1–LP5 are aligned in a straight line parallel to the diameter of the wafer F. FIG. 4B is a front view of the beam emitter section 3 and the beam receiver section 4, FIG. 4C is a side view of the beam emitter section 3 and the beam receiver section 4, and FIG. 4D is a side view of another arrangement of the beam emitter section 3 and the beam receiver section 4. When the incident beams L1–L5 are emitted from the beam emitter section 3, the incident points LP1–LP5 are generated on the surface of the wafer F in a straight line parallel to the diameter of the wafer F.

FIG. 4C is similar to the case shown in FIG. 3C, where both the incident beams L1–L5 and the reflected beams LR1–LR5 are at right angles to the surface of the wafer F. FIG. 4D is similar to the case shown in FIG. 3D, where the incident beams L1–L5 are projected at an angle to the surface, and the reflected beams LR1–LR5 are also reflected at the same angle from the surface.

It can be understood that the locations of the beam emitter and beam receiver sections are not limited to those illustrated in FIGS. 3C and 4C. Other arrangements are permissible so long as there is a one-to-one correspondence in a set of emitter-to-receiver combination, the lengths of the optical paths of the beam emitter and the beam receiver sections are the same, and the angles of incidence and reflections are all the same.

Figure 5:
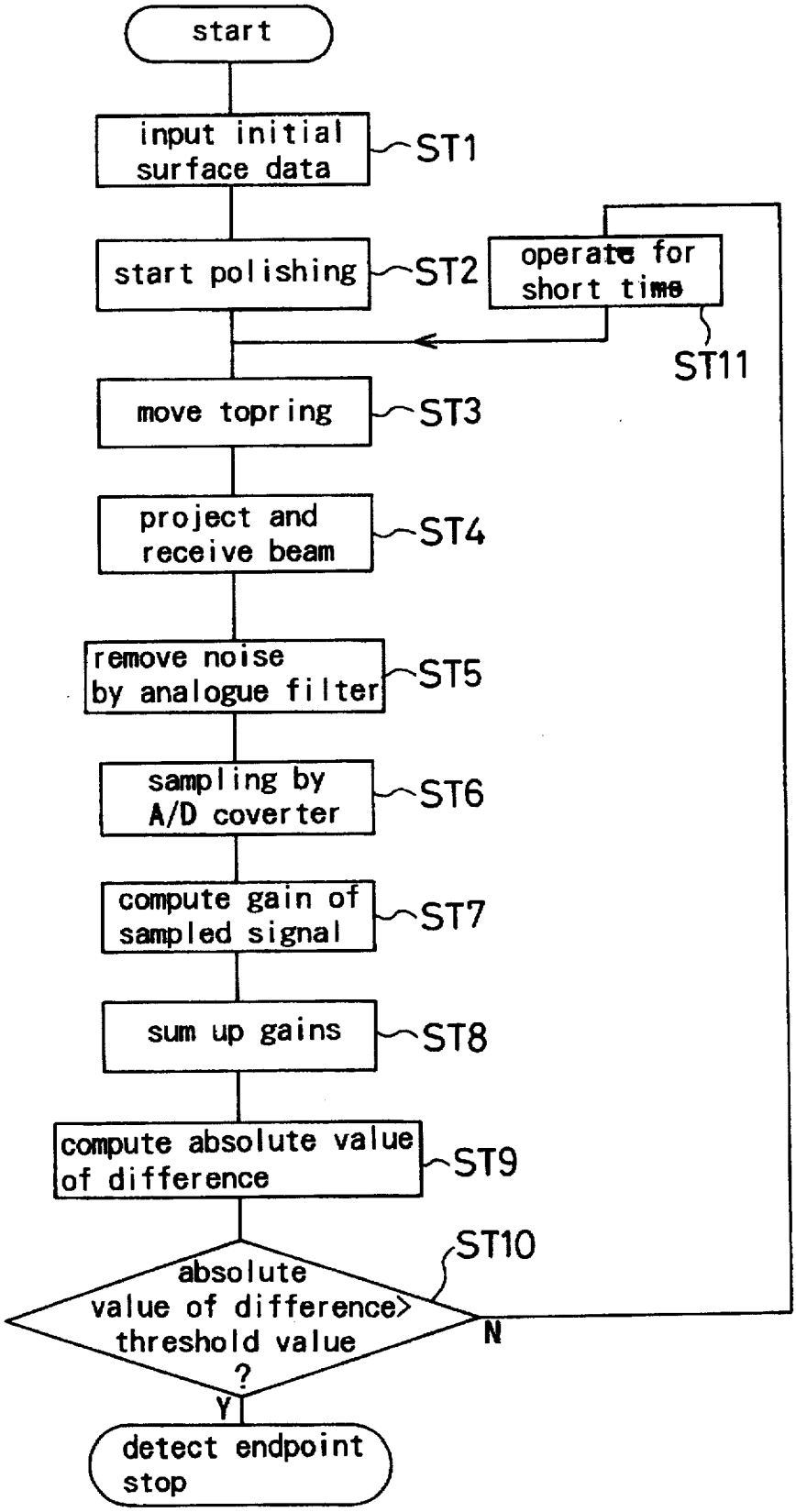
FIG. 5 is a flowchart of an inspection process by the endpoint detection device of the present invention.

FIG. 5 is a flowchart of the steps involved in the endpoint detection process. First, in step ST1, the initial surface condition is determined by measuring the reflection intensities from a surface having an oxide film Ox, and each measured data is added to be used as the initial surface data of the surface. The initial surface data is input into memory in the computing section 8. In step ST2, the operation of the polishing apparatus is started. When a certain period of polishing time, which has been set for a first objective endpoint for polishing, has elapsed (the time for stopping polishing and starting an inspection process is pre-entered in the memory as preparatory data in the computing section 8), the top ring 2 is moved laterally in step ST3, by commands from the control section 9, and the following endpoint inspection steps are performed.

In step ST4, an inspection of the polishing endpoint is carried out by any of the configurations presented above, by projecting the incident beam L1–L5 on the polished surface of the wafer F from the emitter section 3 and receiving the reflected beam LR1–LR5 in the receiver section 4. As mentioned previously, the light from the emitter section is preferably a laser light.

In step ST5, the reflected beams LR1–LR5 received in the receiver section 4 are converted to a electrical signal in the receiver section 4, and the electrical signal is amplified in the amplifier 5 and filtered by the filter 6 to remove noise components. In step ST6, the filtered electrical signal A is converted to digital signals in the D/A converter 7 to be sampled at a certain fixed interval. Each of the sampled signals is forwarded to the computing section 8.

In step ST7, the gain of each sampled signal is computed from the square of the maximum amplitude, and in step ST8, each of the gains is added to obtain an added gain value. In step ST9, the added gain value is compared with the initial added value stored in the memory of the computing section 8 (which is the initial surface condition determined by the reflection intensity from the surface covered with the oxide film Ox), and the absolute value of the difference is computed. In step ST10, the absolute value of the difference, relating the current surface condition of the surface, is compared with a threshold value established in relation to the initial value stored in the computing section 8 and the conditions of polishing being applied to the wafer F.

In step ST10 if the absolute value of the difference exceeds a threshold value, it is decided that the polishing step has been finished, and a stop-polish signal is issued to the control section 9 to stop the polishing apparatus. If the absolute value of the difference does not exceed the threshold value, a resume-polish signal is sent to the control section 9 to resume polishing in step ST11. After a rather short pre-determined time of renewed polishing operation, an inspection is carried out again through the process from step ST3 to ST10. This process should be repeated until the absolute value of the difference exceeds the threshold value.

If should be noted that although an accumulated value of the amplified signals of the reflected beams was used in the above example, an average value of the amplified signals may also be computed and compared with a threshold value. Naturally, the threshold value in this case would be smaller than that based on the absolute value of the difference.

Further, in the above embodiment, a wafer was used as an example of the object being polished, however, any objects having a plate form which require precision planarization can be polished using the endpoint detection device of the present invention.

The salient features of the polishing apparatus having an endpoint detection device of the present invention are summarized in the following.

The endpoint detection device is capable of detecting when a pre-determined endpoint of polishing has been attained while the wafer remains on the top ring of the polishing apparatus. Therefore, if an inspection process determines that the polishing process has not reached the pre-determined endpoint, polishing can be resumed automatically to continue the polishing process. Therefore, the present polishing apparatus is much more superior to the conventional polishing apparatuses which require demounting of the wafer from the top ring to determine if the wafer has reached a pre-determined endpoint, and if it is determined that the endpoint has not been reached, the wafer must be remounted back on the top ring to resume the process of polishing. Therefore, the necessity of handling the wafer for inspection purposes has been essentially eliminated, thereby contributing to more efficient production of polished objects of high precision.

Although the present invention has been illustrated by embodiments having particular devices and arrangement, it is clear to those skilled in the art that other alternative devices and arrangements of the devices can be used to achieve the same effects demonstrated by the principle of determining the uniformity or non-uniformity of the surface condition of a surface being polished by opto-electronic methodology outlined in the present invention.

We claim:

1. A polishing apparatus having a turntable, top ring means for pressing an object to be polished onto said turntable during polishing of a surface of the object, and an endpoint detection means for detecting an endpoint for stopping polishing of the surface of the object, said endpoint detection means comprising:

beam emitting means for projecting light beams onto an exposed portion of the surface of the object being held by said top ring means;

beam receiving means for receiving reflected beams reflected from the exposed portion of the surface; and endpoint judging means for determining a current surface condition of the surface from analysis of said reflected beams, said endpoint judging means comprising an electrical amplifier for amplifying analogue electrical signals received by said beam receiving means, analogue signal filtering means for filtering noise from the thus amplified analogue electrical signals, analogue-to-digital conversion means for converting said amplified analogue electrical signals to digital signals of surface data, computing means for computing an absolute value of a difference between an initial surface data of the surface in an initial unpolished state and current surface data and for comparing said absolute value with a predetermined threshold value to obtain comparison data, and controlling means for controlling operation of said polishing apparatus based on said comparison data.

2. A polishing apparatus as claimed in claim 1, wherein said beam emitting means and beam receiving means are provided at a location outwardly of said turntable, and said polishing apparatus further comprises a drive mechanism for moving said top ring means and the object relative to said turntable so as to expose the exposed portion of the surface of the object at said location.

3. A polishing apparatus as claimed in claim 1, wherein said endpoint judging means determines an endpoint on a basis of changes in intensities of reflected beams reflected from the surface of the object.

4. A polishing apparatus as claimed in claim 1, wherein said beam emitting means of said endpoint detection means comprise a plurality of emitter elements disposed at a common distance from the surface, and said beam receiving means of said endpoint detection means comprise a plurality of corresponding receiver elements disposed at a common distance from the surface, and said computing means is provided with comparing means for computing an absolute value of a difference between an added value or an averaged value of said initial surface data and an added value or an averaged value of said current surface data, and comparing said difference with said predetermined threshold value.

5. A polishing apparatus as claimed in claim 4, wherein said plurality of emitter elements is arranged so as to produce a linear line of incident points on the surface, and said plurality of receiver elements is arranged linearly so as to correspond with respective of said emitter elements and at an equal distance from the surface of the object.

6. A polishing apparatus having a turntable, top ring means for pressing an object to be polished onto said turntable during polishing of a surface of the object, and an endpoint detection means for detecting an endpoint for stopping polishing of the surface of the object, said endpoint detection means comprising:

beam emitting means for projecting light beams onto an exposed portion of the object being held by said top ring means, said beam emitting means comprising a plurality of emitter elements disposed at a common distance from the surface;

beam receiving means for receiving reflected beams reflected from the exposed portion of the surface, said beam receiving means comprising a plurality of receiver elements, corresponding said plurality of emitter elements and disposed at a common distance from the surface; and endpoint judging means for determining a current surface condition of the surface from analysis of said reflected beams, said endpoint judging means comprising computing means for computing an added value or an averaged value of current surface data corresponding to added or averaged intensity of said reflected beams.

7. A polishing apparatus as claimed in claim 6, wherein said beam emitting means and beam receiving means are provided at a location outwardly of said turntable, and said polishing apparatus further comprises a drive mechanism for moving said top ring means and the object relative to said turntable so as to expose at least a portion of the surface of the object to said plurality of emitter elements and said plurality of receiver elements.

8. A polishing apparatus as claimed in claim 6, wherein said computing means has a computing section for computing an absolute value of a difference between an initial surface data of the surface in an initial unpolished state and a current surface data and for comparing said absolute value with a predetermined threshold value to obtain comparison data, and a controlling section for controlling operation of said polishing apparatus based on said comparison data.

9. A polishing apparatus as claimed in claim 8, wherein said computing section is provided with a comparing section for computing an absolute value of a difference between an added value or an averaged value of said initial surface data and an added value or an averaged value of said current surface data, and comparing said difference with said predetermined threshold value.

10. A polishing apparatus as claimed in claim 6, wherein said plurality of emitter elements is arranged so as to produce a linear line of incident points on the surface, and said plurality of receiver elements is arranged linearly so as to correspond with respective of said emitter elements and at an equal distance from the surface of the object.

11. A polishing apparatus as claimed in claim 6, wherein said endpoint judging means further comprises an electrical amplifier for amplifying analogue electrical signals received by said receiver elements, analogue signal filtering means for filtering noise from the thus amplified analogue electrical signals, and analogue-to-digital conversion means for converting said amplified analogue electrical signals to digital signals.

12. A polishing apparatus having a turntable, top ring means for pressing an object to be polished onto said turntable during polishing of a surface of the object, and an endpoint detection means for detecting an endpoint for stopping polishing of the surface on the object, said endpoint detection means comprising:

beam emitting means for projecting light beams onto an exposed portion of the surface of the object being held by said top ring means;

beam receiving means for receiving reflected beams reflected from the exposed portion of the surface;

endpoint judging means for determining a current surface condition of the surface from analysis of said reflected beams; and a drive mechanism for moving said top ring means and the object relative to said turntable so as to expose the exposed portion of the surface of the object, said drive mechanism being operable to drive said top ring means while maintaining constant a distance between the surface of the object and a surface of said turntable.

* * * * *